US005755240A

United States Patent [19]

Schönborn

[11] Patent Number: 5,755,240

[45] Date of Patent: May 26, 1998

[54] DEVICE FOR CLEANING DIRTY NAILS

[76] Inventor: Klaus Schönborn, In der Theussen 10, 42579 Heiligenhaus, Germany

[21] Appl. No.: 736,581

[22] Filed: Oct. 24, 1996

[30] Foreign Application Priority Data

Jul. 12, 1996 [DE] Germany ..... 196 28 198.9

[51] Int. Cl.[6] ..... A45D 29/00

[52] U.S. Cl. ..... 132/74.5; 601/166

[58] Field of Search ..... 132/73, 73.5, 74.5, 132/285; 601/166; 604/292, 293, 316; 134/198, 200

[56] References Cited

U.S. PATENT DOCUMENTS

| | | | |
|---|---|---|---|
| 2,722,224 | 11/1955 | Blann | 132/285 |
| 4,020,856 | 5/1977 | Masterson | 132/74.5 |
| 4,119,439 | 10/1978 | Boucher | 134/200 |
| 4,137,929 | 2/1979 | Grossman . | |
| 4,258,734 | 3/1981 | Hehlo . | |
| 4,289,152 | 9/1981 | Fuhre . | |
| 4,688,585 | 8/1987 | Vetter | 134/198 |
| 4,742,836 | 5/1988 | Buehler | 132/74.5 |

FOREIGN PATENT DOCUMENTS

| | | | |
|---|---|---|---|
| 2647651 | 12/1990 | France | 132/73 |
| 42 33 535 A1 | 7/1994 | Germany . | |

*Primary Examiner*—Todd E. Manahan

*Attorney, Agent, or Firm*—Sixbey, Friedman, Leedom & Ferguson; David S. Safran

[57] ABSTRACT

The invention relates to a device (1) for cleaning dirty nails (2), especially fingernails, which has housing (3) with a cleaning space (4), at least one opening (7) through which at least one nail (2) to be cleaned or a body part (8) which has a nail (2) to be cleaned, especially a finger, can be inserted into the cleaning space (4), and a nozzle body (10, 21) which has at least one nozzle opening (11) from which cleaning liquid from nozzle body (10, 21) flows against at least one nail (2) in the cleaning space (4). To attain a defined and good cleaning result, according to the invention, an extended supporting area (16) with a stop for the tip (17) of the body part (8) is provide on the nozzle body (10, 21), and the nozzle opening(s) is positioned so that, when the tip (17) rests on the supporting area (16) the nozzle opening(s) (11) is unobstructed, a gap (18) between tip (16) and nail (2) being opened when the tip (17) resting on the supporting area (16) is pressed in a direction toward the supporting area (16), is moved at the same time in a direction toward the nozzle opening(s) and the nozzle opening (11) being aligned in a direction toward the gap (18) thus opened.

14 Claims, 3 Drawing Sheets

DEVICE FOR CLEANING DIRTY NAILS

BACKGROUND OF THE INVENTION

1. Field of the Invention

The invention relates to a device for cleaning dirty nails, especially fingernails, with a housing, a cleaning space within the housing that is accessible via at least one opening, through which at least one nail to be cleaned or a body part which has a nail to be cleaned, especially a finger, can be inserted into the cleaning space, and a nozzle body which has at least one nozzle opening from which cleaning liquid from the nozzle body flows against the at least one nail in cleaning space.

2. Description of Related Art

A device of the type to which the invention is directed is known as a nail bath and an example of such device can be found in published German Patent Application DE 42 33 535 A1. In the cleaning space of the known device, there is a so-called catch element which is located at some distance above the nozzle and offset to the side thereof as a separate part. The catch element is thus located adjacent to the nozzle such that, by exerting force in the longitudinal direction of the finger, upon interaction with the catch element, a frictional force which acts between the fingertip and the catch element is generated by which the gap between the fingertip and nail is opened.

Although the known device offers rather good cleaning results, it has some disadvantages. Since the catch element and the nozzle have a spatially fixed lateral offset to one another, when cleaning fingers of different thicknesses, it can happen that the water from the nozzle is not sprayed directly into the gap between the fingertip and the nail, being sprayed onto the fingertip for thick fingers and laterally past on the fingernail for thin fingers.

Another disadvantage of the known nail bath is that the finger with the nail to be cleaned can easily slide downward from the catch element and strike the nozzle there. This can be unpleasant and painful. If, finally, the finger with the nail to be cleaned is located too deep in the cleaning space or too near the nozzle, there is a danger that the nozzle opening will be unintentionally closed at least partially by the fingertip, so that the desired cleaning effect is not achieved.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

SUMMARY OF THE INVENTION

The task of the invention is therefore to make available a device for cleaning of dirty fingernails of the initially mentioned type, with which in any case a good result of cleaning the dirty nail is achieved and in which any danger of injury to the user is precluded.

This object is achieved in a device for cleaning dirty nails of the initially mentioned type in which there is an extended or planar supporting area on the nozzle body which serves as a stop for the tip of body part inserted. When the tip rests on the supporting area, the nozzle opening is not obstructed, and the gap between the tip and the nail is opened when force is exerted in the direction toward the supporting area. If body part is moved at the same time in the direction toward the nozzle opening, nozzle opening is aligned in a direction toward opened gap The embodiment according to the invention ensures that the tip abuts a fixed point, specifically the support area. It is not possible to slip from this area, so that there is no danger of injury. By placing the tip against the support surface, moreover, a guide or stop for the body part is formed so that the tip, if it rests on the support area, is in the optimum position for cleaning.

Additionally, the gap between the tip and the nail is opened in this position if a force is exerted in the direction toward the supporting area and the finger is moved in the direction toward the nozzle opening. The resulting frictional force provides for this. Here, it is also ensured that, in each case, cleaning liquid flows against the gap, regardless of whether the respective user has thick or thin fingers. Recognizably the new nozzle body combines a host of different functions in itself.

Other features, advantages and possible applications follow from the subclaims and subsequent description of embodiments using the drawing and from the drawing itself.

DETAILED DESCRIPTION OF THE PREFERRED EMBODIMENT

Figure 1:
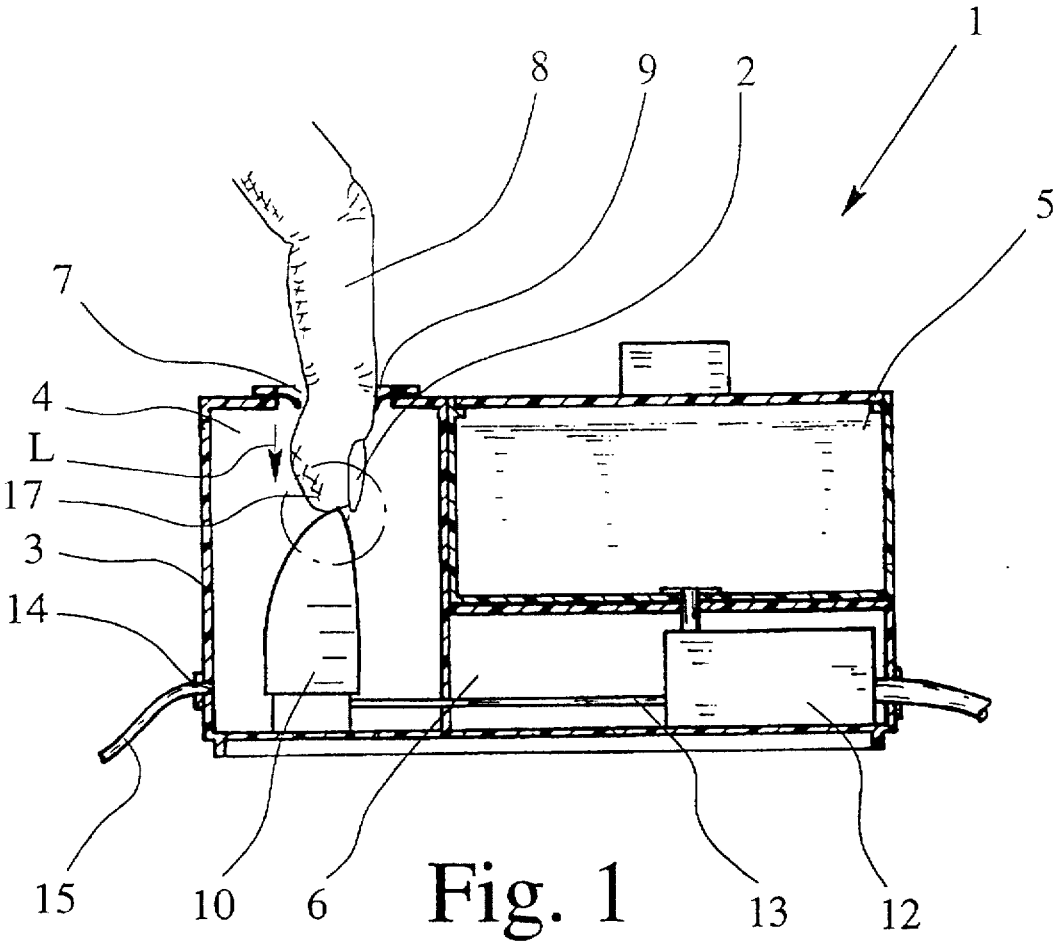
FIG. 1 shows a side cross sectional view of a device according to the invention.
Figure 2:
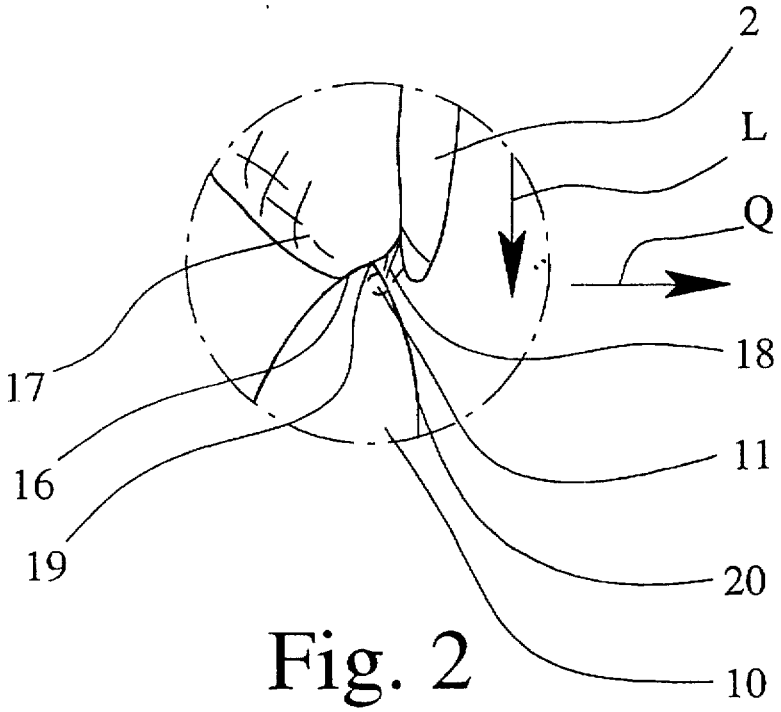
FIG. 2 shows an enlarged view of the encircled detail X in FIG. 1.
Figure 3:
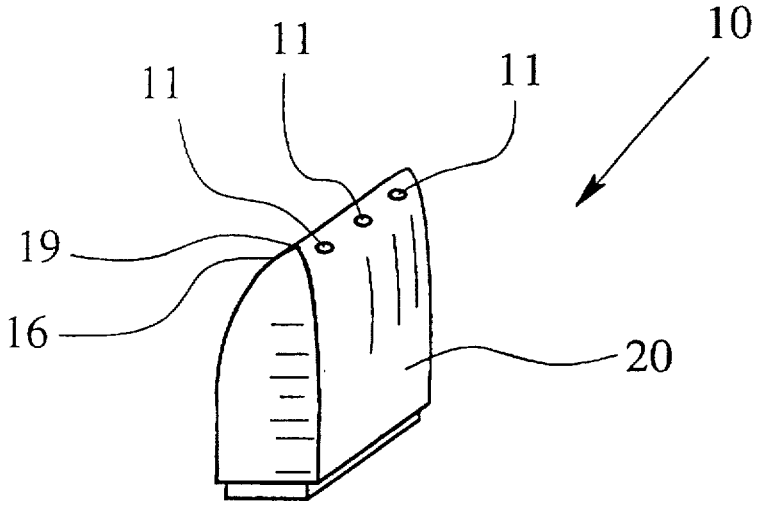
FIG. 3 is a perspective view of a nozzle body according to the invention.
Figure 4:
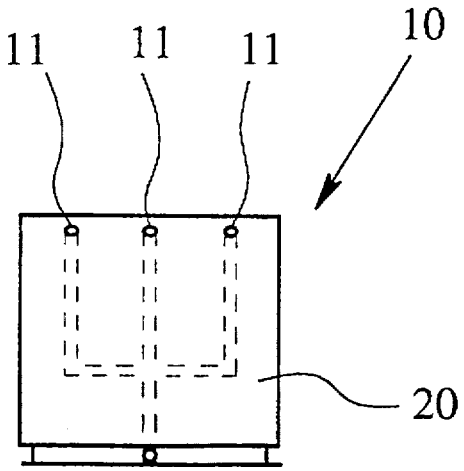
FIG. 4 shows a front view of the nozzle body of FIG. 3.
Figure 5:
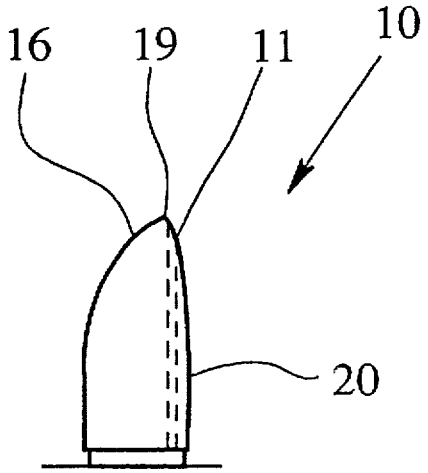
FIG. 5 is a side elevational view of the nozzle body of FIG. 3.

FIG. 1 shows device 1 for cleaning dirty nails 2. In this case, device 1 is used to clean fingernails. Device 1 has a housing 3. Within the housing 3 is a cleaning space 4, reservoir 5 for cleaning liquid and a separately sealed space 6. Body part 8, here a finger, can be inserted through an opening 7 into the cleaning space 4. In opening 7, is at least one, preferably an annular, sealing lip 9. Furthermore, a nozzle body 10, which has at least one nozzle opening 11 is located in cleaning space 4. In this embodiment, according to FIGS. 3–5, the nozzle body has three nozzle openings 11.

In FIG. 1, the device 1 is shown during use. From reservoir 5, cleaning liquid is sucked via a pump 12, located in space 6, and is delivered via a line 13 to the nozzle body 10. The cleaning liquid is then discharged via the nozzle openings 11 in nozzle body 10 in a direction toward nail 2. The cleaning liquid is removed via an outlet opening 14 located in the lower area of cleaning space 4. Here, cleaning space 4 can be joined via a hose 15 to an external discharge or collecting tank (not shown) for holding "dirty" cleaning liquid.

Of course, it goes without saying that, instead of opening 7 being designed for receiving only one body part 8, opening 7 could be sized to receive several body parts 8, or several openings 7 could be provided, each of which receives a separate body part 8. In this way, for example, all five fingers of one hand, or the toes of a foot, could be inserted into the cleaning space at one time.

It is significant that there is an extended or planar supporting area 16 for tip 17 of body part 8 on nozzle body 10, and that when tip 17 is rested on supporting area 16, the nozzle opening 11 is essentially unobstructed. Supporting area 16 is, therefore, used to limit the downward motion of the finger when it is inserted. Tip 16, thus, makes contact with supporting area 16. Since the supporting area 16 is intentionally made to support tip 17, contact of tip 17 with the supporting area 16 is not unpleasant for the user.

It should be pointed out that supporting area 16 does not extend into the area of nozzle opening 11, ending in front of this area. For this reason, the nozzle opening 11 remains unobstructed. It is also important that, when the tip 17 rests on supporting surface 16 and when force is exerted on it, gap 18 between the tip 17 and the nail 2 is opened if tip 17 is moved in the direction L toward nozzle opening 11. This yields a frictional force opposite direction L. Finally, it is provided that nozzle opening 11 is aligned in the direction of the opened gap 18.

In the embodiment shown in FIGS. 1 through 5, the nozzle body 10 has an edge-like stop 19 for tip 17 in the area of its upper end. Stop 19 more or less represents the end of supporting area 16. Nozzle openings 11 are located under stop 19 in nozzle body 10. The aforementioned execution of nozzle body 10 can be best accomplished when nozzle body 10 terminates in an acute angle on its upper end with formation of stop 19. As a result of this design with the acute or sharp edge, it is easily possible for the user to place tip 17 correctly on the nozzle body 10.

Gap 18, which can be opened by exerting force on supporting area 16 or stop 19 and by moving the body part in direction L, based on the frictional force which arises, can also be opened, in this embodiment, by motion in transverse direction Q when tip 17 has been placed on stop 19. Because the wall 20 which has the nozzle opening(s) 11 falls steeply following stop 19, the nail 2 or its inner side is prevented from being pressed against wall 20 during cleaning; this could be unpleasant for the user.

The width of wall 20 depends on whether one or more fingers are to be cleaned at the same time on nozzle body 10. For only one finger, the width of wall 20 is between 0.5 and 2 cm.

Figure 6:
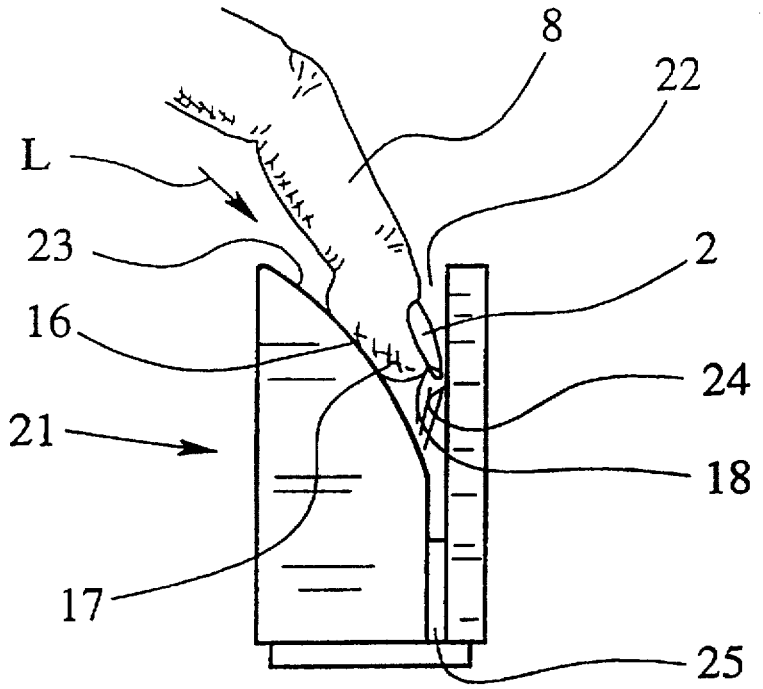
FIG. 6 shows a side view of another nozzle body embodiment.
Figure 7:
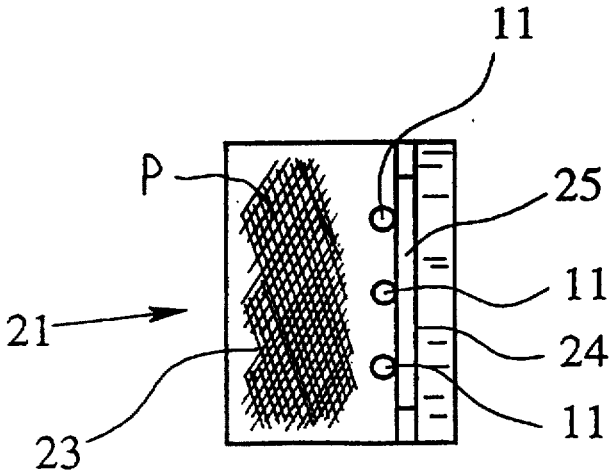
FIG. 7 is a top plan view of the FIG. 6 nozzle body.

FIGS. 6 & 7 show another nozzle body 21. Nozzle body 21 has an insertion gap 22 which is upwardly open for insertion of body part 8. Insertion gap 22 becomes narrower toward the bottom. This is done such that one wall 23 which borders insertion gap 22 has an arc or curve shaped contour, while the opposite wall 24 is arranged essentially vertically. Wall 23 can be not only arched or curved, but, basically, can also have a slanted contour. Supporting area 16 is provided on this wall 23.

Nozzle openings 11 are located in the lower area of insertion gap 22 on the lower end of wall 23. The arrangement of nozzle openings 11 in the lower area is selected such that nozzle openings 11 are located outside of supporting area 16. Since insertion gap 22 is very narrow in its lower area, insertion of tip 17 into this area is not possible.

Due to the aforementioned design of nozzle body 21 with walls 23 and 24, there is a defined insertion of the finger into gap 22 of nozzle body 21. Regardless of the size of the finger, ideal placement and arrangement of nail 4 within nozzle body 21 is guaranteed, since the outside of nail 2 ultimately strikes wall 24 when the finger is inserted into insertion gap 22. By means of the corresponding pressure of tip 17 on the supporting area 16 and movement of the tip in direction L, when nail 2 meets wall 24, due to the friction which occurs, gap 18 is opened wide enough so that good cleaning can take place.

To drain the cleaning liquid out of nozzle body 21, it is fundamentally provided that insertion gap 22 is opened to the side and/or to the bottom. In this embodiment, insertion gap 22 has drain opening 25 which is open to the bottom.

Although, in the embodiments shown nozzle, the bodies 10, 21 are made in one piece overall, it goes without saying that nozzle bodies 10, 21 can basically also be made in several parts. Therefore, each nozzle body can have at least one separate nozzle element around which or on which the respective "nozzle body" is then arranged, and by which, however, its above described contact, stop, guide and function of opening gap 18 would not change.

It desirable for supporting area 16 to have a grip-enhancing surface provided thereon. This grip enhancement can be accomplished by a corresponding selection of material (for example, with a nonslip plastic) and/or, as shown in FIG. 7, by corresponding profiling P (knurling, burls, transverse grooves or other roughened texturing).

Furthermore, on the nozzle body 10, there is a switch (not shown) for turning on and off of the pump 11 which supplies the cleaning liquid. This switch is made such that, when force is exerted on supporting area 16, the pump 11 is turned on, while, when the finger is withdrawn, pump 11 is turned off again. An suitable conventional pressure switch can be used for this purpose.

To be able to clean nozzle body 10, it is moreover provided that it be detachably mounted so as to be interchangeable/replaceable.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. Device for cleaning dirty nails of body parts comprising a housing having a cleaning space and at least one opening through which at least one body part which has a nail to be cleaned is insertable into the cleaning space, at least one nozzle body which has at least one nozzle opening for directing a flow of cleaning liquid against at least one nail in the cleaning space, and means for supplying cleaning liquid to the at least one nozzle opening of the at least one nozzle body; wherein there is an extended supporting area for the at least one body part on the at least one nozzle body and a stop for a tip of the at least one body part; wherein said at least one nozzle opening is located below said stop in the at least one nozzle body and outside the supporting area and is positioned relative to said supporting area when said tip rests on the supporting area said at least one nozzle opening is unobstructed by said tip, and the at least one nozzle opening is aligned toward a gap between the tip and nail which is opened when force is applied to the tip resting on the supporting area in a direction toward the supporting area and the body part is moved simultaneously in a direction toward the at least one nozzle opening.

2. Device according to claim 1, wherein said stop is formed by an edge surface of the at least one nozzle body in the area of an upper end thereof.

3. Device according to claim 2, wherein the upper end of the at least one nozzle body terminates in an acute angle.

4. Device according to claim 1, wherein a wall of the at least one nozzle body on which the at least one nozzle opening is located falls steeply from said at least one nozzle opening.

5. Device according to claim 1, wherein the at least one nozzle body has an upwardly open insertion gap which tapers downward and which is defined on one side by a first wall which slopes downward and contains said supporting area thereon; and wherein said at least one nozzle opening is provided in a lower area of the insertion gap.

6. Device according to claim 5, wherein a second side of the insertion gap which is opposite the first wall is essentially vertical and acts as said stop; and wherein a lower area of the insertion gap is too narrow for insertion of said tip therein.

7. Device according to claim 5, wherein the insertion gap has an opening for drainage of the cleaning liquid.

8. Device according to claim 7, wherein the opening for drainage of the cleaning liquid is at a bottom area of the insertion gap.

9. Device according to claim 7, wherein the opening for drainage of the cleaning liquid is at a side area of the insertion gap.

10. Device according to claim 1, wherein the supporting area has a grip-enhancing surface.

11. Device according to claim 10, wherein said grip-enhancing surface is provided by said surface being formed of a nonslip plastic material.

12. Device according to claim 10, wherein said grip-enhancing surface is provided by said surface being formed with a surface texturing.

13. Device according to claim 1, wherein a switch for turning on and off of a pump of said means for supplying cleaning liquid interacts with said at least one nozzle body in a manner causing the pump to be in an operating state only as long as a force is exerted via said tip on said supporting area.

14. Device according to claim 1, wherein the nozzle body is detachably mounted to said housing so as to be replaceable.

* * * * *